US005641165A

United States Patent [19]

Page

[11] Patent Number: 5,641,165

[45] Date of Patent: Jun. 24, 1997

[54] INTRANSITIVE DICE AND METHOD OF USE

[76] Inventor: Robert A. Page, 30473 Mulholland Hwg. #139, Agoura, Calif. 91301

[21] Appl. No.: 574,519

[22] Filed: Dec. 19, 1995

[51] Int. Cl.[6] ..... A63F 9/04

[52] U.S. Cl. ..... 273/246; 273/274

[58] Field of Search ..... 273/247, 268, 273/274, 146

[56] References Cited

U.S. PATENT DOCUMENTS 5,133,559 7/1992 Page ..... 243/146

FOREIGN PATENT DOCUMENTS 757509 9/1956 United Kingdom ..... 273/146

OTHER PUBLICATIONS

Scarn's New Complete Guide to Gambling, by John Scarne (New York: Simon & Schuster, Inc.) 1974 511–513.

Scientific American, "Nontransative Dice" Dec. 1970.

*Primary Examiner*—William M. Pierce
*Attorney, Agent, or Firm*—Ted Masters

[57] ABSTRACT

A plurality of six-sided intransitive dice 10 include dice having two different sizes and three different colors. Indicia of three different colors and representing numeric values, is disposed on the six sides of the dice. Intransitive dice 10 are used to play a wagering game 700 between a contestant and an opponent, wherein the contestant always has an advantage.

26 Claims, 9 Drawing Sheets

INTRANSITIVE DICE AND METHOD OF USE

TECHNICAL FIELD

The present invention pertains generally to dice and more particularly to a plurality of intransitive dice and a method of use in a wagering game.

BACKGROUND ART

Intransitive dice are well known in mathematical circles, constituting a paradox which runs counter to conventional transitive logic. For example, three dice designated A, B, and C each have numbers disposed on their six sides. The numbers are not the standard 1 through 6, but rather such numbers as:

Die A—1, 1, 4, 4, 4, 4;

Die B—3, 3, 3, 3, 3, 3; and,

Die C—2, 2, 2, 2, 5, 5.

If die A is rolled against die B, die A will produce a higher number (win) more than fifty percent of the time. Similarly, if die B is rolled against die C, die B will win more than fifty percent of the time. One would reasonably suspect then that since die A beat die B, and die B beat die C, that die A should also beat die C. This would be a transitive relationship. Surprisingly however, if die C is rolled against die A, die C will also win more than fifty percent of the time, thereby exhibiting the intransitive nature of the set of dice.

U.S. Pat. No. 5,133,559 shows several sets of intransitive dice which are applied to a casino dice game. The fifteen sets of three intransitive dice which posses the highest winning percentages are disclosed. The fifteen sets are used in the play of a casino game in which either single die or double die contests are offered.

Funkenbusch, W. W. in "Sheep Fleecing Dice", Journal of Recreational Mathematics, vol 15(3), 1982–1983, pp. 194–198, describes the application of several sets of intransitive dice to various wagering games.

DISCLOSURE OF INVENTION

The present invention is directed to specialized sets of intransitive dice, and a method of using the dice in a wagering game played between a contestant who is familiar with the intransitive properties of the dice, and an opponent who is not. The contestant is therefore able to adopt a playing strategy in which he/she always has an advantage. The intransitive dice may be either used in single die contests where the contestant's die is rolled against the opponent's die, or in double die contests where the contestant and the opponent each have two dice which are rolled. In a preferred embodiment six dice are provided. The first three dice have a first die size, are of three different die colors, and have three different indicia colors. The second three dice have a second die size, are of the same three different die colors, and have the same three different indicia colors. The indicia represent numeric values which are disposed on the six sides or faces of the dice. One possible name for the dice and associated game is DAZZLING DICE.

In a typical playing situation, the contestant, and owner of the dice, invites the opponent to play a new dice game. The contestant produces the six dice described above, and suggests that since this is a wagering game a small wager is in order. The contestant may even offer the opponent "odds" since the contestant admits to having played the game before. The contestant then asks the opponent to select a die (any one of the six provided), whereby the contestant then selects a same sized die. Since the opponent has selected first, the contestant can always select a die that will beat the opponent's die more than 50% of the time. The dice are then rolled and the player whose die has the higher numeric value wins the wager. After a few rounds of play, the opponent will observe that he/she is losing the majority of the contests. The contestant may then offer the opponent the choice of selecting a different die, including the die currently being used by the contestant. The opponent agrees, and the contestant then makes a corresponding selection of a same sized die. The new dice are then rolled with the predictable result of the opponent still losing a majority of the contests. In another playing option, the contestant may suggest that the player whose die has the lower numeric value wins the wager. Of course here to, the contestant can select a die that will win more than 50% of the time.

Tiring of his/her losing ways, the opponent may reasonably demand that the contestant select the first die. In response, the contestant offers the opponent an even "better deal". The contestant not only agrees to select first and let the opponent select second, but in "a flare of supreme generosity", also lets the opponent make the contestant's selection. Again both selected dice must be the same size. After both dice are selected by the opponent, the contestant has the option of either (1) having the two selected dice rolled as before in the single die contest, or (2) having the opponent additionally select a different size die for him/herself, and also select a different size die for the contestant resulting in a double die contest. The only restriction is that the second die selected for the contestant must bear the same relationship to the contestant's first die as the opponent's second die bears to the opponent's first die. The relationships may be either (1) the same die color, (2) the same indicia color, or (3) neither the same die color nor the same indicia color. The contestant helpfully explains that if the same relationship is not observed, troublesome and time-consuming ties may occur. True indeed, however the contestant's real motive is to bring the intransitive nature of the dice into play and thereby gain the advantage. The contestant may further point out that the opponent makes all of the die selections, only being bounded by the same relationship requirement. The contestant on the other hand makes no die selections. Does this not give the opponent an undisputable advantage?

After selection, the two contestant's dice are rolled against the two opponents dice and the dice having the higher numeric total win. Not surprisingly, the opponent finds that he/she still loses more than 50% of the time.

At the player's option, the game may then continue with the contestant's two dice being rolled again against the opponent's two dice, or the opponent selecting two new same sized dice and two new different sized dice, or may revert to the original single die contest format wherein each player selects one die with the opponent selecting first. Alas, no matter whether the single or double die playing formats are used, no matter what die or dice the opponent selects, and no matter whether the better numeric total is high or low, the opponent will always lose more than 50% of the time.

The abovestated game is made possible by the fact that in single intransitive dice contests, there is always a die which can beat a first-selected die. Similarly, for double intransitive dice contests, there is always a pair of dice which can beat a first-selected pair, and the "same relationship" requirement ensures that the contestant will have the better dice so long as the contestant's first die would be beaten by that of the opponent.

In accordance with a preferred embodiment of the present invention, the indicia colors are the same as the die colors.

In accordance with another preferred embodiment of the present invention, seven specific sets of intransitive dice are disclosed, each set possessing one or more unique properties.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
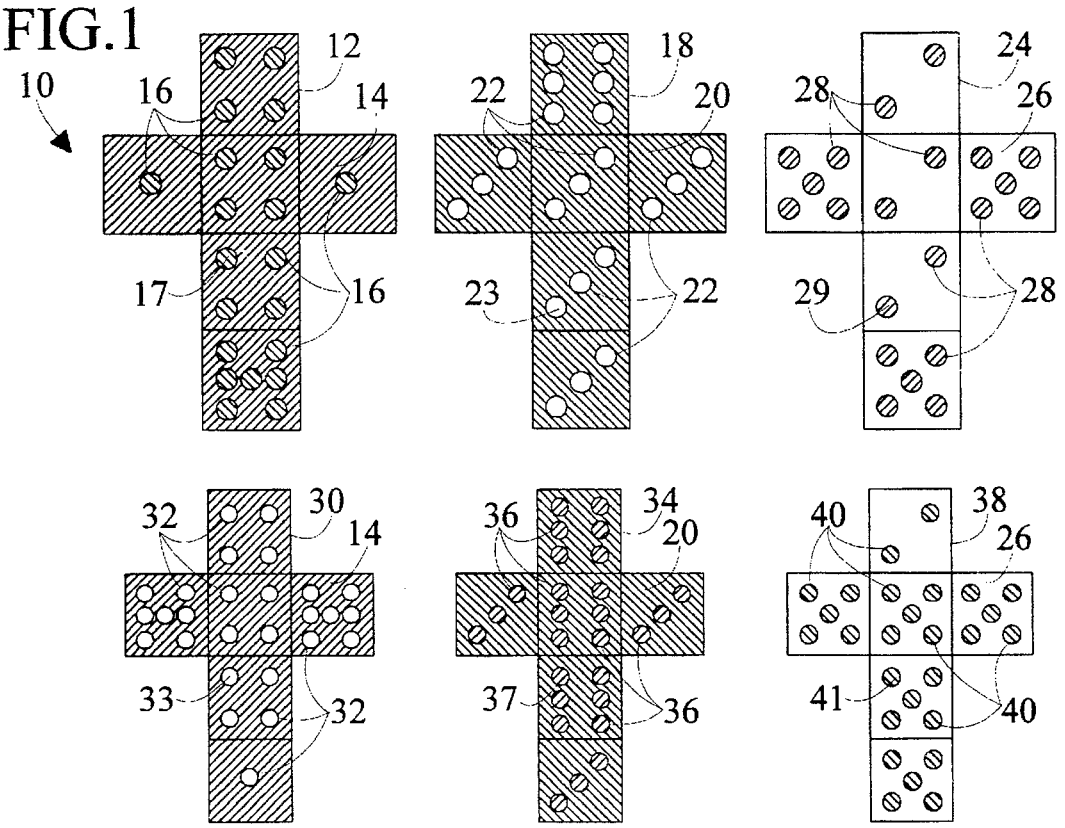
FIG. 1 is an unfolded view of a first set of intransitive dice in accordance with the present invention.

Referring initially to FIG. 1 there is illustrated an unfolded view of the six sides (faces) of a first set of intransitive dice in accordance with the present invention, generally designated as 10. All the dice have a conventional cube shape. The set of dice 10 includes a first die 12 having a first die color 14 (indicated by right-to-left hatching). First die 12 also has indicia 16 disposed on each of its six sides which represent numeric values. In the shown embodiment the numeric values are 1, 1, 4, 4, 4, and 7. It is noted that dots are used to represent the numeric values. However, other representations such as lines, written words, or written or printed numbers (such as in FIG. 3 herein) could also be employed. Indicia 16 has a first indicia color 17 (indicated by left-to-right hatching) which is different from first die color 14.

A second die 18 has a second die color 20 (indicated by left-to-right hatching) different from first die color 14. Second die 18 has indicia 22 disposed on each of its six sides which represent numeric values. In the shown embodiment the numeric values are 3, 3, 3, 3, 3, and 6. Indicia 22 has a second indicia color 23 (indicated by white) which is different from both second die color 20 and first indicia color 17.

A third die 24 has a third die color 26 (indicated by white) different from both first die color 14 and second die color 20. Third die 24 has indicia 28 disposed on each of its six sides which represent numeric values. In the shown embodiment the numeric values are 2, 2, 2, 5, 5, and 5. Indicia 28 has a third indicia color 29 which is different from third die color 26, and also different from both first indicia color 17 and second indicia color 23.

The die colors 14, 20, and 26 of the three dice can be chosen to emphasize any number of themes. For example, the colors red, white, and blue would convey a United States theme, while the colors red, white, and green would similarly convey a Mexican or Italian theme. The indicia colors 17, 23, and 29 each preferably match one of the dice colors as is shown in FIG. 1. Alternatively, one or more of the indicia colors may be different from the colors of the dice.

Set of dice 10 further includes a fourth die 30 having first die color 14 (indicated by right-to-left hatching). Fourth die 30 also has indicia 32 disposed on each of its six sides which represent numeric values. In the shown embodiment the numeric values are 1, 4, 4, 4, 7, and 7. Indicia 32 has an indicia color 33 (indicated by white) which is the same as either second indicia color 23 or third indicia color 29, but different from both first die color 14 and first indicia color 16. In the embodiment shown, indicia color 33 is the same as second indicia color 23 since third indicia color 29 is the same as first (and fourth) die color 14.

A fifth die 34 has second die color 20 (indicated by left-to-right hatching). Fifth die 34 also has indicia 36 disposed on each of its six sides which represent numeric values. In the shown embodiment the numeric values are 3, 3, 3, 6, 6, and 6. Indicia 36 has an indicia color 37 (indicated by right-to-left hatching) which is the same as either first indicia color 17 or third indicia color 29, but different from both second die color 20 and second indicia color 23. In the embodiment shown, indicia color 37 is the same as third indicia color 29 since first indicia color 17 is the same as second (and fifth) die color 20.

A sixth die 38 has third die color 26 (indicated by white). Sixth die 38 also has indicia 40 disposed on each of its six sides which represent numeric values. In the shown embodiment the numeric values are 2, 5, 5, 5, 5, and 5. Indicia 40 has an indicia color 41 (indicated by left-to-right hatching) which is the same as either first indicia color 17 or second indicia color 23, but different from both third die color 26 and third indicia color 29. In the embodiment shown, indicia color 40 is the same as first indicia color 17 since second indicia color 23 is the same as third (and sixth) die color 26.

In a preferred embodiment first die 12 is green with red indicia, second die 18 is red with white indicia, third die 24 is white with green indicia, fourth die 30 is green with white indicia, fifth die 34 is red with green indicia, and sixth die 38 is white with red indicia. In an alternative embodiment, first die 12 is green with white indicia, second die 18 is red with green indicia, third die 24 is white with red indicia, fourth die 30 is green with red indicia, fifth die 34 is red with white indicia, and sixth die 38 is white with green indicia. It may be readily appreciated that a myriad of other color combinations could also be employed.

First die 12, second die 18, and third die 24 each have a first distinguishing feature. Similarly, fourth die 30, fifth die 34, and sixth die 38 each have a second distinguishing feature. In the embodiment shown the first distinguishing feature of die 12, die 18, and die 24 is a first die size (large), and the second distinguishing feature of die 30, die 34, and die 38 is a second die size (small) which is different from the first die size. That is, dice 12, 18, and 24 can be clearly distinguished from dice 30, 34, and 38 by die size. It may be readily appreciated however, that other first and second distinguishing features could also be employed. For example die shape could be utilized wherein die 12, die 18, and die 24 have conventional sharp edges and corners, while die 30, die 34, and die 38 have rounded edges and corners. Also, indicia type could be utilized wherein die 12, die 18, and die 24 use dots, while die 30, die 34, and die 38 use printed numerals. Another possibility would be for die 12, die 18, and die 24 to have some form of distinguishing marking such as gold edges, while die 30, die 34, and die 38 have silver edges. The possibilities are obviously endless. The important aspect, however achieved, is that dice 12, 18, and 24 be clearly distinguishable from dice 30, 34, and 38.

The intransitive properties of first set of intransitive dice 10 is described as follows. Designating first die 12 as die A (having indicia disposed on the six sides representing the numbers 1,1,4,4,4,7), designating second die 18 as die B (having indicia disposed on the six sides representing the numbers 3,3,3,3,3,6), designating third die 24 as die C (having indicia disposed on the six sides representing the numbers 2,2,2,5,5,5), designating fourth die 30 as die A', read A "prime", (having indicia disposed on the six sides representing the numbers 1,4,4,4,7,7), designating fifth die 34 as die B' (having indicia disposed on the six sides representing the numbers 3,3,3,6,6,6), and designating sixth die 38 as die C' (having indicia disposed on the six sides representing the numbers 2,5,5,5,5,5), the intransitive relationship of dice A, B, and C is:

$$A>B>C>A,$$

where A>B denotes that if dice A and B are rolled, die A will have a higher numeric value (on its upward face) than die B more that 50% of the time. Similarly, die B will have a higher numeric value than die C, and die C will have a higher numeric value than die A.

To verify this relationship for dice A and B, it is first noted that there are 36 possible numeric combinations using two dice. If a 1 appears on die A (two occurrences), die A can never win over die B (i.e. have a higher numeric value than die B). If a 4 appears on die A (three occurrences), die A wins over die B in five instances (five 3's on die B) for a number of die A wins of 3 (occurrences)×5 (wins)=15. Similarly, if a 7 appears on die A (one occurrence), die A wins over die B in all six instances (five 3's and one 6) for a number of die A wins of 1×6=6. Therefore, die A wins a total of 21 (15+6) out of 36 times, or 58.3% of the time. Put another way, die A wins 1.4 times (21/15) to every one win of die B for a winning ratio of 1.4. Table 1 summarizes the above calculations.

TABLE 1

Die B

| Num. value | Occur. |
|---|---|
| 3 | 5 |
| 6 | 1 |

Die A

| Num. value | Occur. | Instances Over Die B | Die A Wins |
|---|---|---|---|
| 1 | 2 | 0 | 0 |
| 4 | 3 | 5 | 15 |
| 7 | 1 | 6 | 6 |
| | | Total Die A Wins (21/36 = 58.3%), or a winning ratio of 21/15 = 1.4 | 21 |

A similar analysis applies to contests between die B and die C where die B has a winning ratio of 1.4, and to contests between die C and die A where die C also has a winning ratio of 1.4.

The intransitive relationship of dice A', B', and C' is:

$$A'>B'>C'>A',$$

where A+≦B' denotes that if dice A' and B' are rolled, die A' will have a higher numeric value (on its upward face) than die B' more that 50% of the time. Similarly, die B' will have a higher numeric value than die C', and die C' will have a higher numeric value than die A'. As was the case for dice A, B, and C, the winning ratio in all three instances is 1.4.

Now the intransitive nature of various combinations of first set of intransitive dice 10 will be explored. In the first combination, dice A and A' are combined, dice B and B' are combined, and dice C and C' are combined. If one of these combinations is rolled against another combination, the following intransitive relationships exist (where A+A' is read A and A'):

$$A+A'<B+B'<C+C'<A+A',$$

where A+A'<B+B' denotes that if dice A and A' are rolled against dice B and B', dice B and B' will have a higher total numeric value (on their upward faces) than dice A and A' more that 508 of the time. That is, the direction of intransitivity has mysteriously reversed. Similarly, dice C and C' will have a higher numeric value than dice B and B', and dice A and A' will have a higher numeric value than dice C and C'.

To verify this relationship for dice A+A' against dice B+B', it is first noted that there are 36×36 (1296) possible numeric combinations using four dice. Dice A and A' can combine to form the 36 total numeric values cited in Table 2. Similarly, dice B and B' can combine to form the 36 total numeric values also cited in Table 2.

TABLE 2

Dice A + A'

| Num. value | Occur. |
|---|---|
| 2 | 2 |
| 5 | 9 |
| 8 | 14 |
| 11 | 9 |
| 14 | 2 |

Dice B + B'

| Num. value | Occur. | Instan. Over A + A' | B + B' Wins |
|---|---|---|---|
| 6 | 15 | 11 | 165 |
| 9 | 18 | 25 | 450 |
| 12 | 3 | 34 | 102 |
| | | Total Die B + B' Wins (717/1296) = 55.3%, or a winning ratio of (717/1296-717) = 1.24 | 717 |

If when dice B+B' are rolled, they have a total numeric value of 6 (15 occurrences), they will win over (i.e. have a higher numeric total) dice A+A' when the dice A+A' numeric total is 2 (2 occurrences) or 5 (9 occurrences), for a total number of dice B+B' wins of 15×11(9+2)=165. Similarly, if the total numeric value of dice B+B' is 9 (18 occurrences), dice B+B' will win if the total numeric value of dice A+A' is 2, 5, or 8 (a total of 25 occurrences), for a total number of dice B+B' wins of 18×25=450. And lastly, if the total numeric value of dice B+B' is 12 (3 occurrences), dice B+B' will win if the total numeric value of dice A+A' is 2, 5, 8, or 11 (a total of 34 occurrences), for a total number of dice B+B' wins of 3×34=102. The total number of dice B+B' wins is therefore 165+450+102=717, or 55.3% of the time, or a winning ratio of 1.24 B+B' wins for one A+A' win.

A similar analysis applies to contests between dice B+B' and dice C+C' where dice C+C' have a winning ratio of 1.44, and to contests between dice C+C' and dice A+A', where dice A+A' have a winning ratio of 1.24. It is noted that contests between dice A+A', B+B', and C+C' represent contests between two dice of the same die color against two dice of a different die color.

Two other combinations of first set of intransitive dice 10 are also possible wherein a "prime" die is combined with a "non-prime" die. These result in the following intransitive relationships and corresponding winning ratios:

$$A+B' \underset{1.34}{<} B+C' \underset{1.34}{<} C+A' \underset{1.22}{<} A+B'; \text{ and,}$$
$$A'+B \underset{1.29}{<} B'+C \underset{1.29}{<} C'+A \underset{1.27}{<} A'+B.$$

It is noted that contests between A'+B, B'+C, and C'+A, represent contests between two dice having the same indicia color and two dice having a different indicia color And, contests between A+B', B+C', and C+A', represent contests between two dice which have neither the same die color nor the same indicia color against two other dice which have neither the same die color nor the same indicia color.

First set of intransitive dice 10 are unique and therefore a preferred embodiment of the present invention for four reasons:

1. First size dice (12, 18, and 24) and the second size dice (30, 34, 38) represent two distinct intransitive sets. This is in contrast to the other sets of intransitive dice disclosed herein, where the numeric values of the second size set is simply a repeat of those of the first size set;
2. All of the single die contests (i.e. A against B, B against C, etc. have the same winning ratio of 1.4;
3. Of the 15 cited contests (six single and nine double), the average winning ratio is the second highest of any six dice intransitive set except the set disclosed in FIG. 2; and,
4. The dice can be grouped in unique 8's compliment pairs. First die 12 and fourth die 30 form such a pair wherein the numbers on corresponding faces of the dice all add to 8. Similarly, second die 18 and sixth die 38, and third die 24 and fifth die 34, form 8's compliment pairs.

It may be appreciated that while first set of intransitive dice 10 was utilized as the vehicle to explain the various intransitive relationships, both for six possible single die contests and the nine possible contests between pairs of dice, these same intransitive relationships hold for other sets of intransitive dice, and are specifically applicable to the intransitive sets disclosed in FIGS. 2 through 7 herein.

Figure 2:
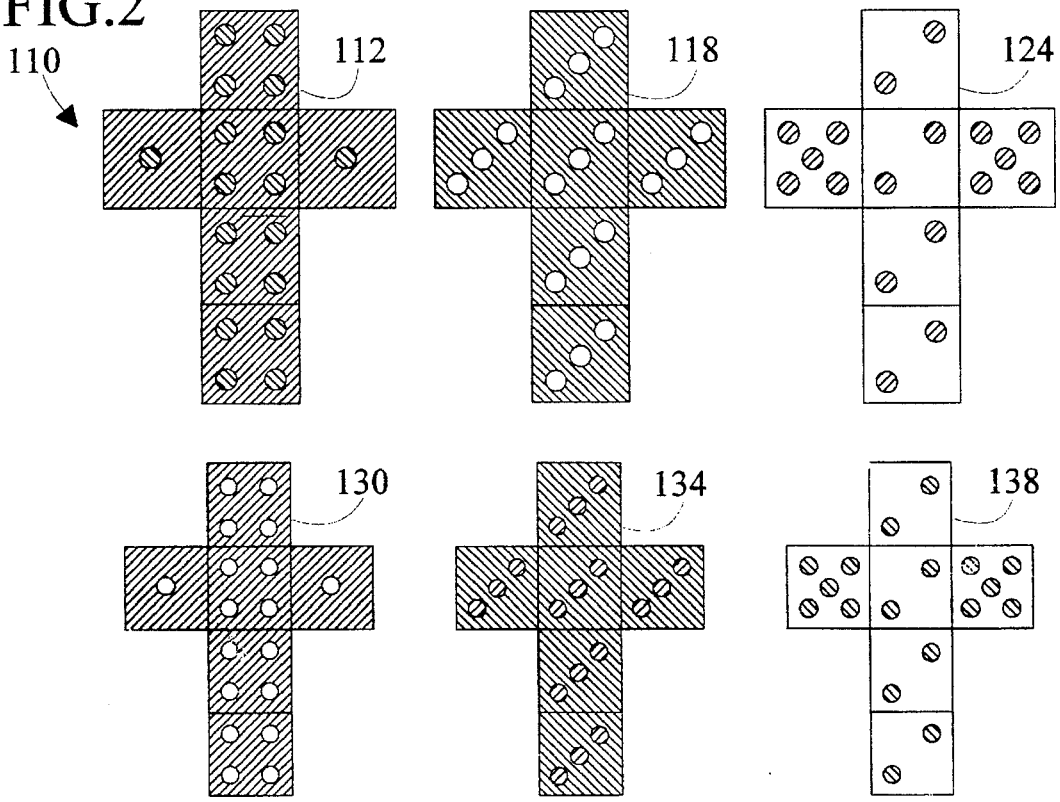
FIG. 2 is an unfolded view of a second set of intransitive dice.

FIG. 2 is an unfolded view of a second set of intransitive dice in accordance with the present invention, generally designated as 110. The set is comprised of first die 112, second die 118, third die 124, fourth die 130, fifth die 134, and sixth die 138. Dice 112, 118, and 124 are of a first size, and dice 130, 134, and 138 are of a second size. The die colors and indicia colors are the same as those shown in FIG. 1 and described in the specification for first set of intransitive dice 10. The indicia disposed on the six sides of first die 112 represent the numbers 1, 1, 4, 4, 4, 4. The indicia disposed on the six sides of second die 118 represent the numbers 3, 3, 3, 3, 3, 3. The indicia disposed on the six side of third die 124 represent the numbers 2, 2, 2, 2, 5, 5. The indicia disposed on the six sides of fourth die 130 represent the numbers 1, 1, 4, 4, 4, 4. The indicia disposed on the six sides of fifth die 134 represent the numbers 3, 3, 3, 3, 3, 3. And, the indicia disposed on the six sides of sixth die 138 represent the numbers 2, 2, 2, 2, 5, 5. Second set of intransitive dice 110 is unique in that the average winning ratio is the highest of all intransitive sets.

Figure 3:
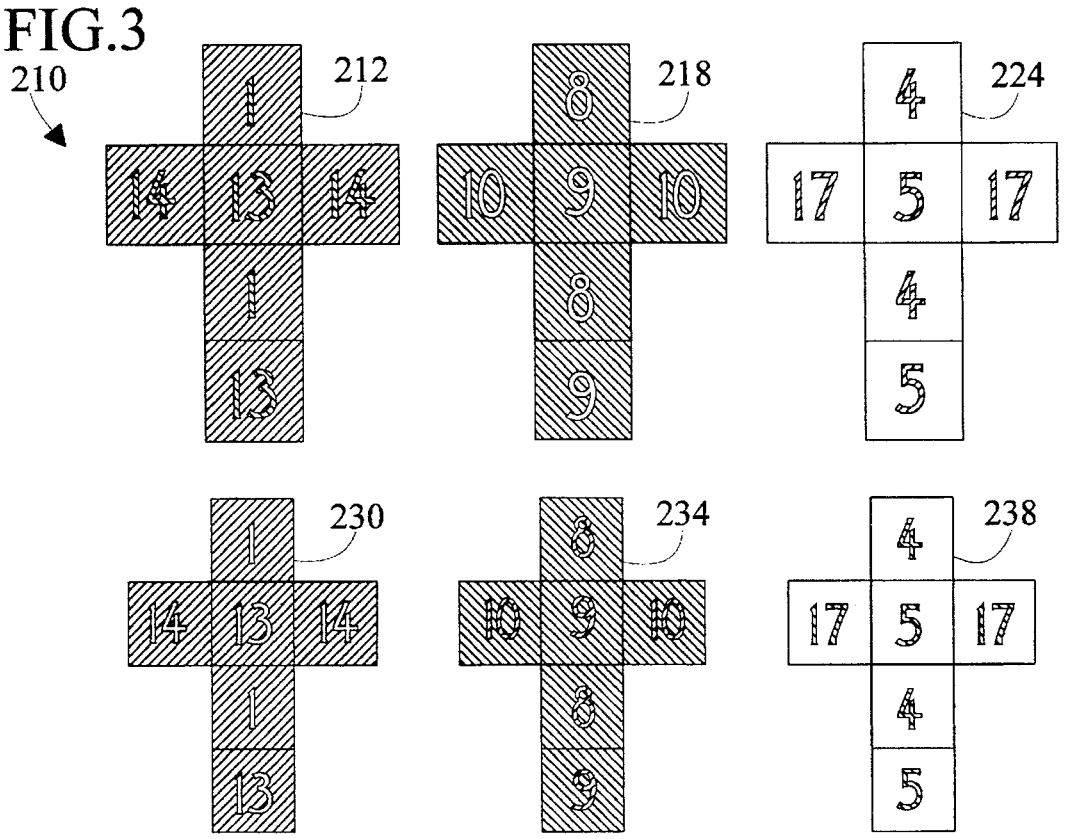
FIG. 3 is an unfolded view of a third set of intransitive dice.

FIG. 3 is an unfolded view of a third set of intransitive dice in accordance with the present invention, generally designated as 210. The set is comprised of first die 212, second die 218, third die 224, fourth die 230, fifth die 234, and sixth die 238. Dice 212, 218, and 224 are of a first size, and dice 230, 234, and 238 are of a second size. The die colors and indicia colors are the same as those shown in FIG. 1 and described in the specification for first set of intransitive dice 10. The indicia disposed on the six sides of first die 212 represent the numbers 1, 1, 13, 13, 14, 14. The indicia disposed on the six sides of second die 218 represent the numbers 8, 8, 9, 9, 10, 10. The indicia disposed on the six side of third die 224 represent the numbers 4, 4, 5, 5, 17, 17. The indicia disposed on the six sides of fourth die 230 represent the numbers 1, 1, 13, 13, 14, 14. The indicia disposed on the six sides of fifth die 234 represent the numbers 8, 8, 9, 9, 10, 10. And, the indicia disposed on six sides of sixth die 238 represent the numbers 4, 4, 5, 5, 17, 17.

Third set of intransitive dice 210 is modified version of second set of intransitive dice 110. The numbers on second set 110 are small and could perhaps be analyzed by an opponent. Therefore, set 110 has been modified (masked) by substituting a set of consecutive integers for the numbers 1 through 5. The substitutions are:

| Set 110 Number | Set 210 Number |
|---|---|
| 1 | 1 |
| 2 | 4, 5 |
| 3 | 8, 9, 10 |
| 4 | 13, 14 |
| 5 | 17 |

It is noted that the substituted numbers have intervals of three (i.e. 1 and 4, 5 and 8, 10 and 13, 14 and 17). This spacing assures that no ties will result when two dice are rolled against another two dice.

Figure 4:
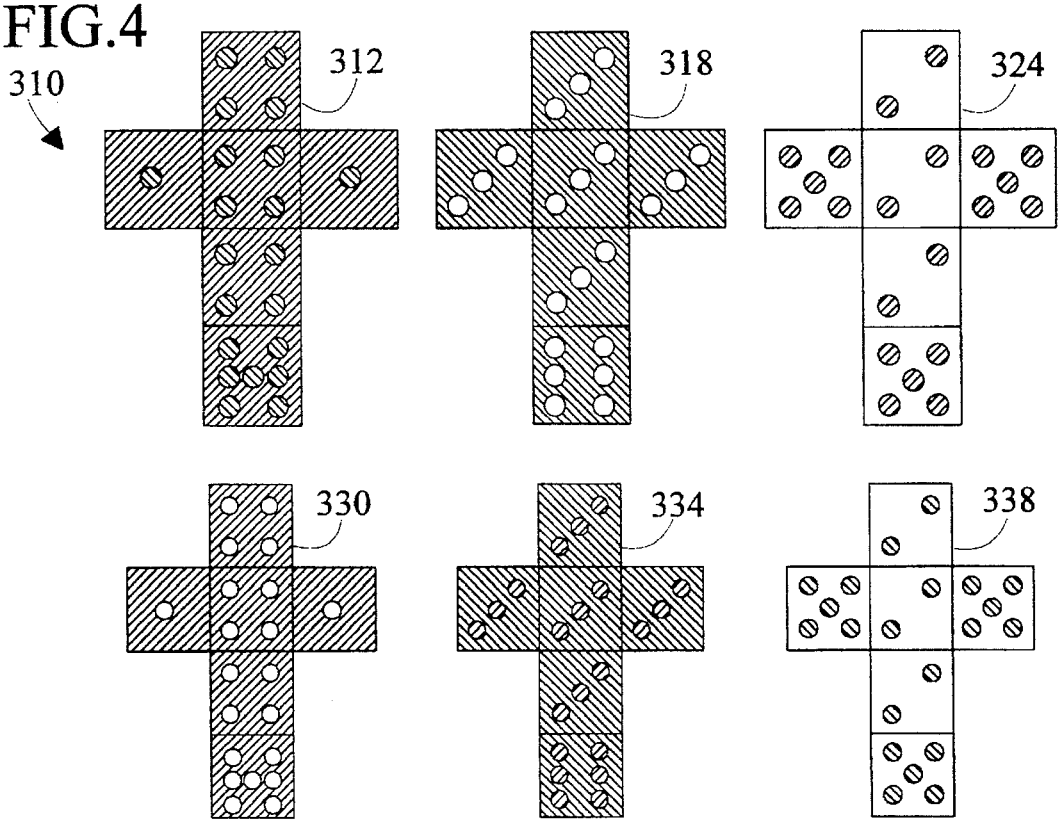
FIG. 4 is an unfolded view of a fourth set of intransitive dice.

FIG. 4 is an unfolded view of a fourth set of intransitive dice in accordance with the present invention, generally designated as 310. The set is comprised of first die 312, second die 318, third die 324, fourth die 330, fifth die 334, and sixth die 338. Dice 312, 318, and 324 are of a first size, and dice 330, 334, and 338 are of a second size. The die colors and indicia colors are the same as those shown in FIG. 1 and described in the specification for first set of intransitive dice 10. The indicia disposed on the six sides of first die 312 represent the numbers 1, 1, 4, 4, 4, 7. The indicia disposed on the six sides of second die 318 represent the numbers 3, 3, 3, 3, 3, 6. The indicia disposed on the six sides of third die 324 represent the numbers 2, 2, 2, 5, 5, 5. The indicia disposed on the six sides of fourth die 330 represent the numbers 1, 1, 4, 4, 4, 7. The indicia disposed on the six sides of fifth die 334 represent the numbers 3, 3, 3, 3, 3, 6. And, the indicia disposed on six sides of sixth die 338 represent the numbers 2, 2, 2, 5, 5, 5. For all two die contests, fourth set of intransitive dice 310 have a winning ratio of at least 1.22.

Figure 5:
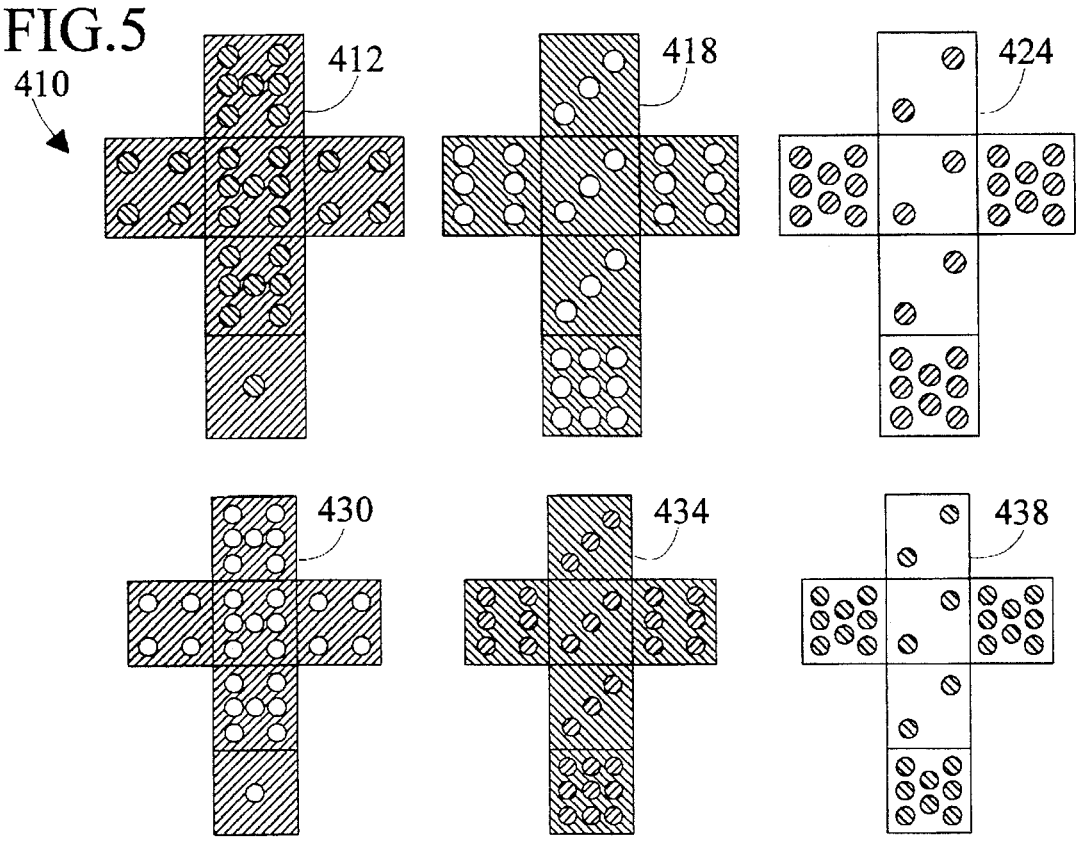
FIG. 5 is an unfolded view of a fifth set of intransitive dice.

FIG. 5 is an unfolded view of a fifth set of intransitive dice in accordance with the present invention, generally designated as 410. The set is comprised of first die 412, second die 418, third die 424, fourth die 430, fifth die 434, and sixth die 438. Dice 412, 418, and 424 are of a first size, and dice 430, 434, and 438 are of a second size. The die colors and indicia colors are the same as those shown in FIG. 1 and described in the specification for first set of intransitive dice 10. The indicia disposed on the six sides of first die 412 represent the numbers 1, 4, 4, 7, 7, 7. The indicia disposed on the six sides of second die 418 represent the numbers 3, 3, 3, 6, 6, 9. The indicia disposed on the six side of third die 424 represent the numbers 2, 2, 2, 8, 8, 8. The indicia disposed on the six sides of fourth die 430 represent the numbers 1, 4, 4, 7, 7, 7. The indicia disposed on the six sides of fifth die 434 represent the numbers 3, 3, 3, 6, 6, 9. And, the indicia disposed on six sides of sixth die 438 represent the numbers 2, 2, 2, 8, 8, 8. For all two die contests, fifth set of intransitive dice 410 have a winning ratio of at least 1.15.

Figure 6:
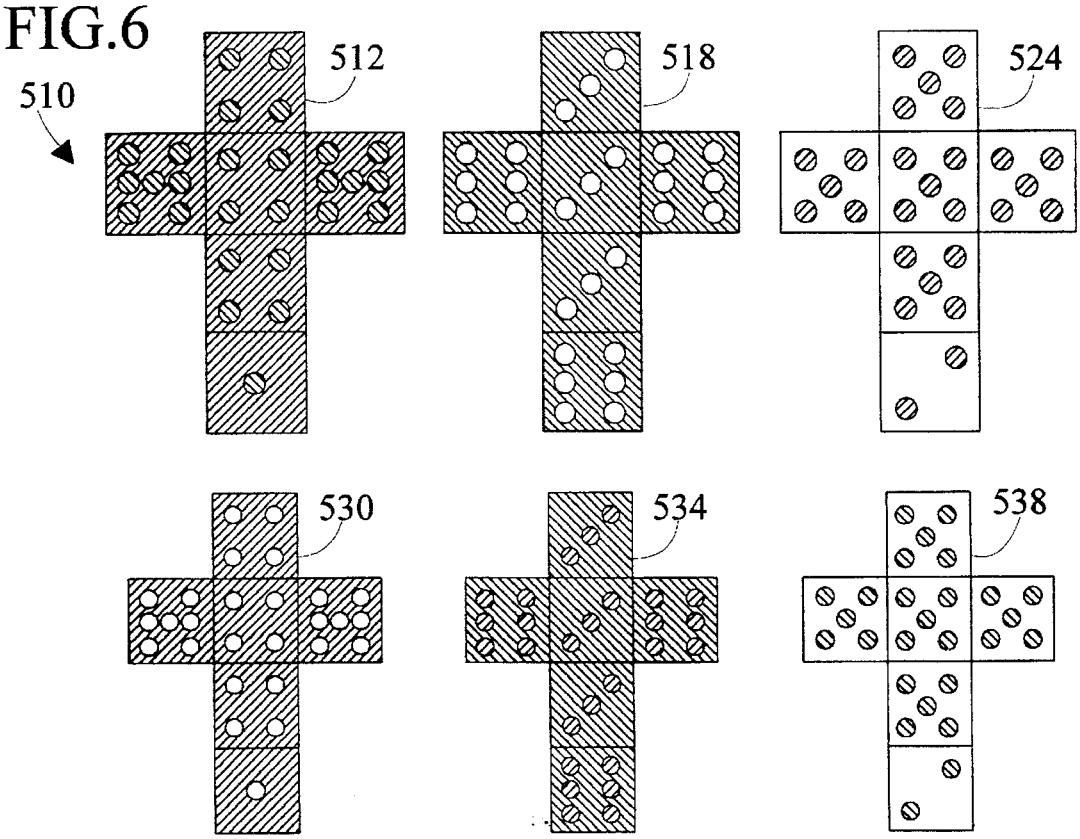
FIG. 6 is an unfolded view of a sixth set of intransitive dice.

FIG. 6 is an unfolded view of a sixth set of intransitive dice in accordance with the present invention, generally designated as 510. The set is comprised of first die 512, second die 518, third die 524, fourth die 530, fifth die 534, and sixth die 538. Dice 512, 518, and 524 are of a first size, and dice 530, 534, and 538 are of a second size. The die colors and indicia colors are the same as those shown in FIG. 1 and described in the specification for first set of intransitive dice 10. The indicia disposed on the six sides of first die 512 represent the numbers 1, 4, 4, 4, 7, 7. The indicia disposed on the six sides of second die 518 represent the numbers 3, 3, 3, 6, 6, 6. The indicia disposed on the six side of third die 524 represent the numbers 2, 5, 5, 5, 5, 5. The indicia disposed on the six sides of fourth die 530 represent the numbers 1, 4, 4, 4, 7, 7. The indicia disposed on the six sides of fifth die 534 represent the numbers 3, 3, 3, 6, 6, 6. And, the indicia disposed on six sides of sixth die 538 represent the numbers 2, 5, 5, 5, 5, 5. For all two die contests, sixth set of intransitive dice 510 have a winning ratio of at least 1.22.

Figure 7:
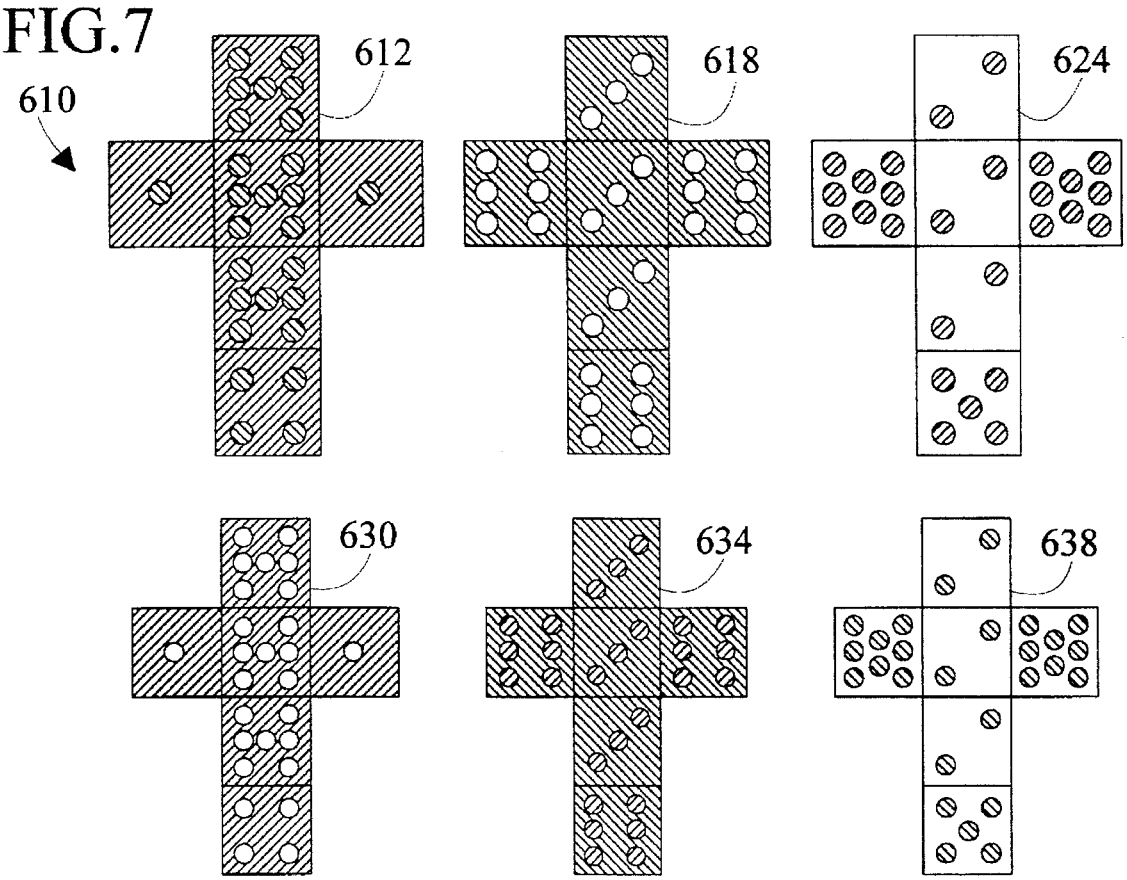
FIG. 7 is an unfolded view of a seventh set of intransitive dice.
Figure 8A:
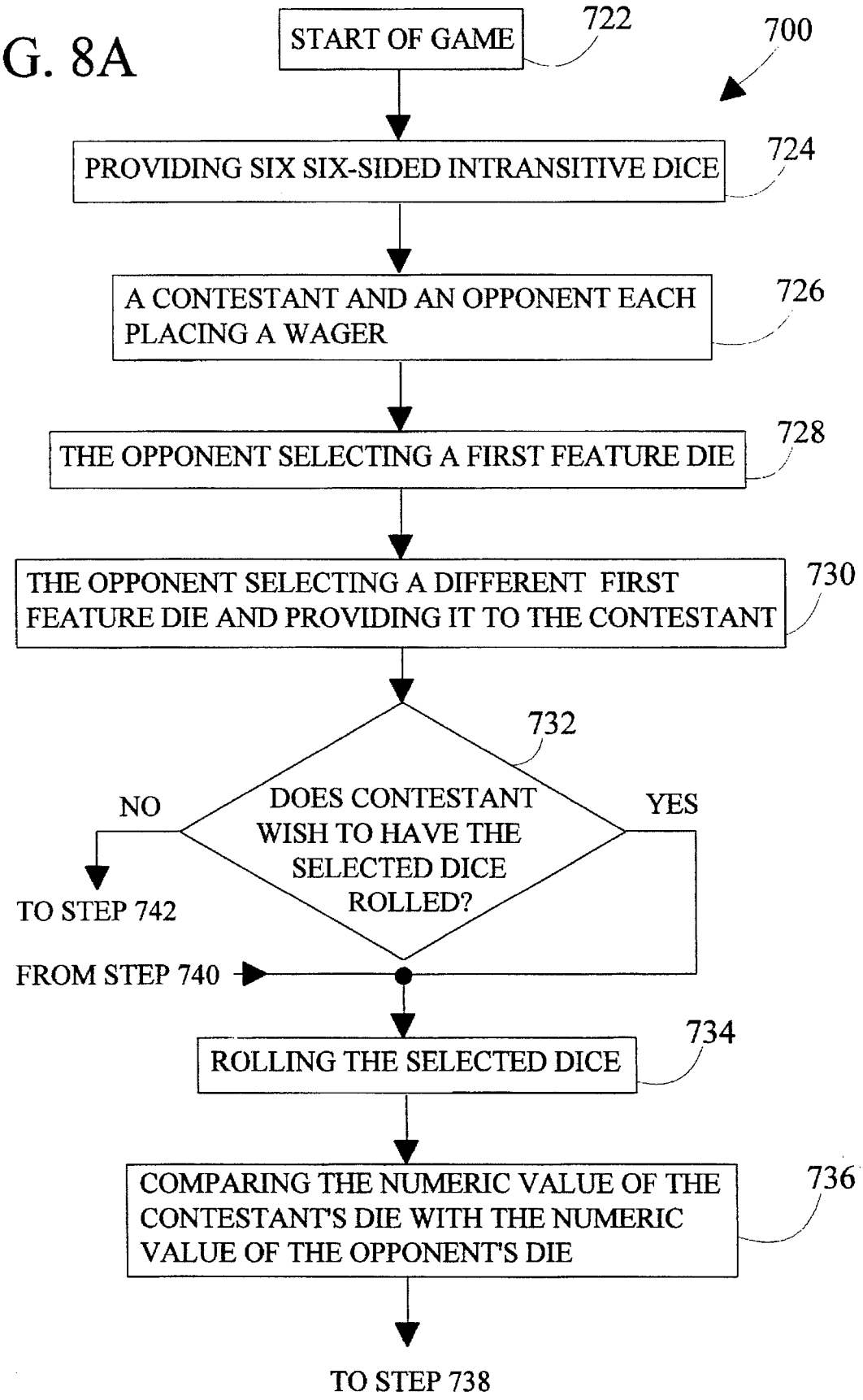
FIGS. 8A–8D are flow diagrams illustrating a method of playing a wagering game using intransitive dice; and, FIG. 9 is a flow diagram illustrating a method of playing a supplemental wagering game using intransitive dice.
Figure 8B:
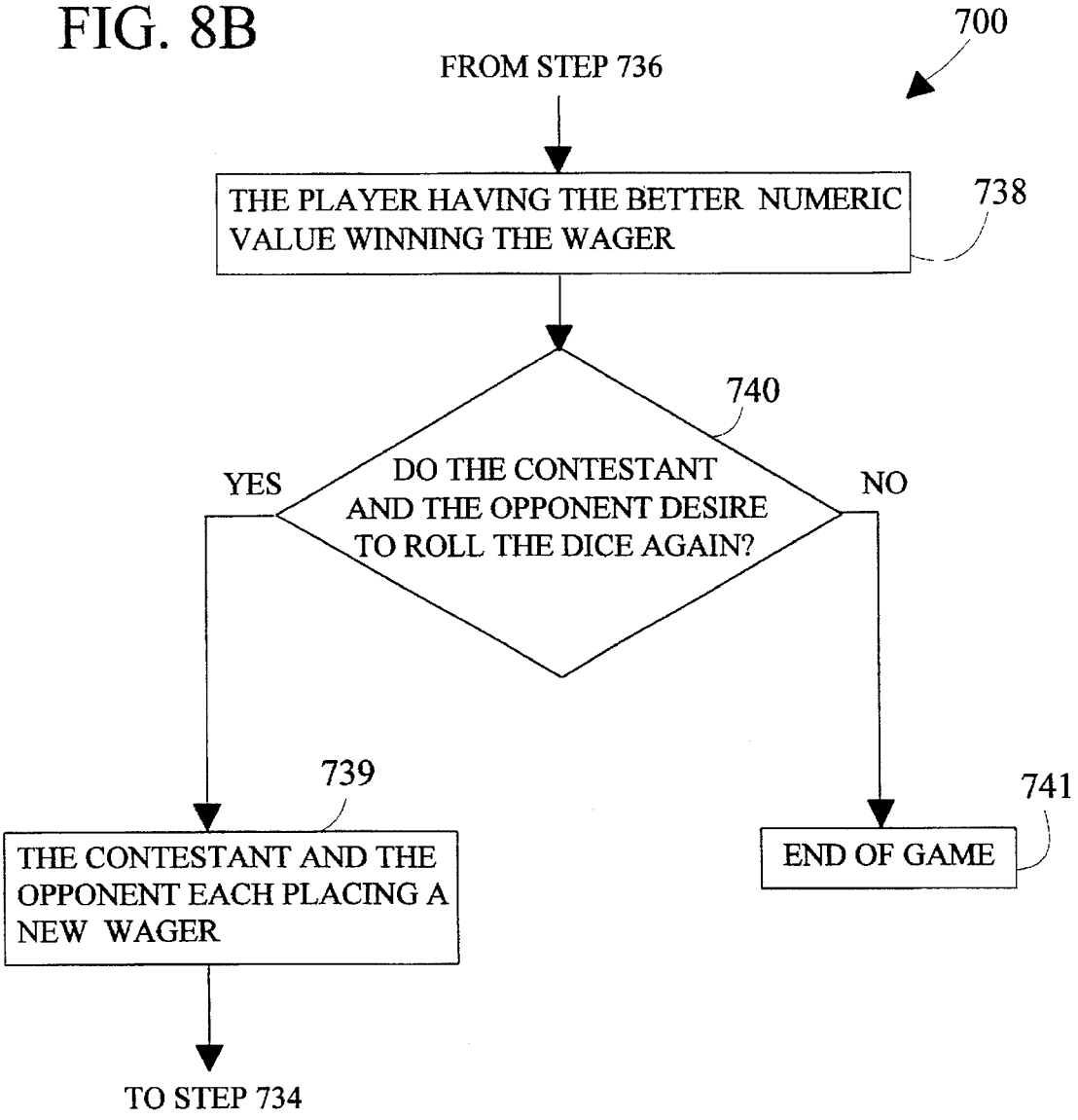
Figure 8C:
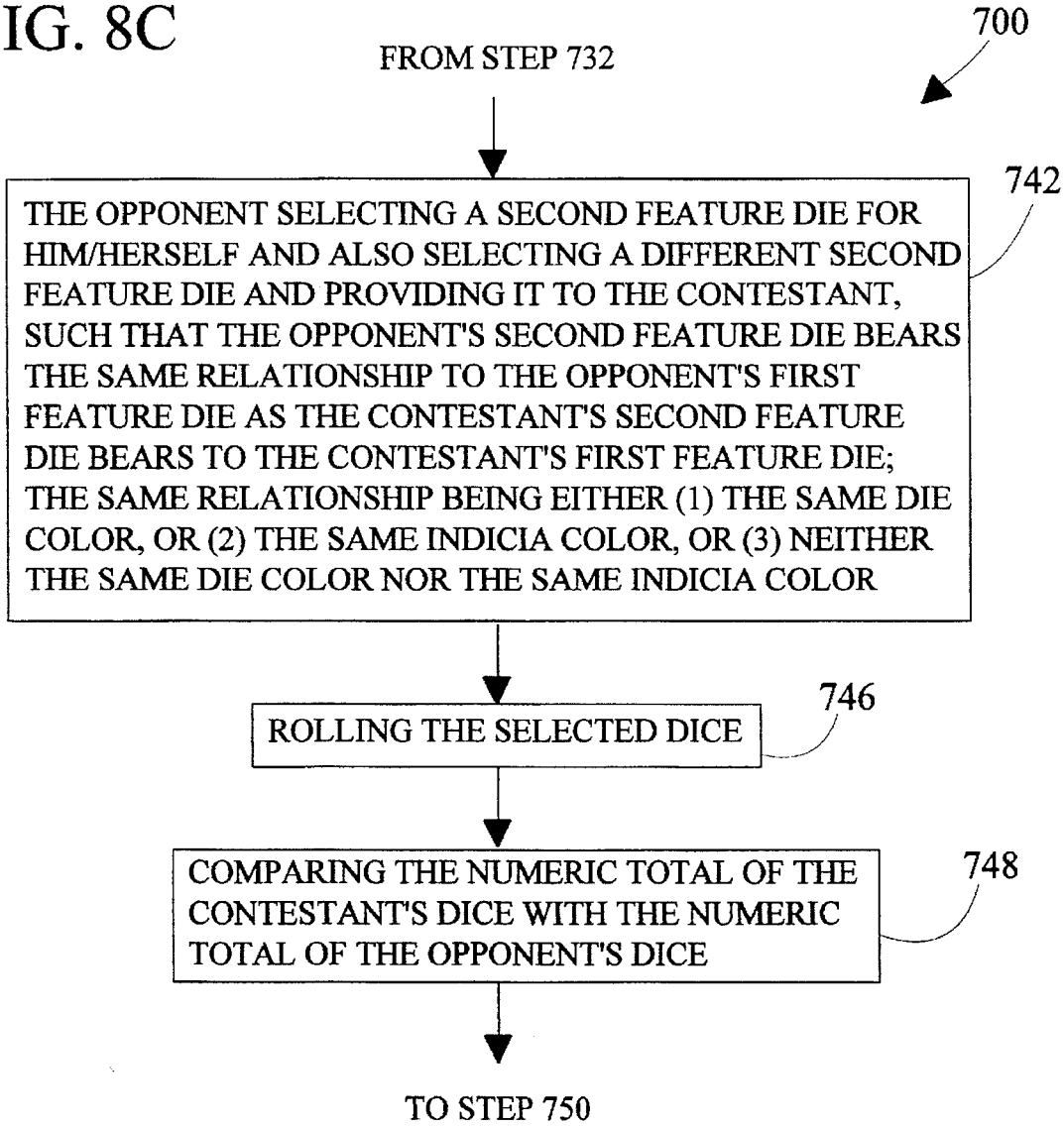
Figure 8D:
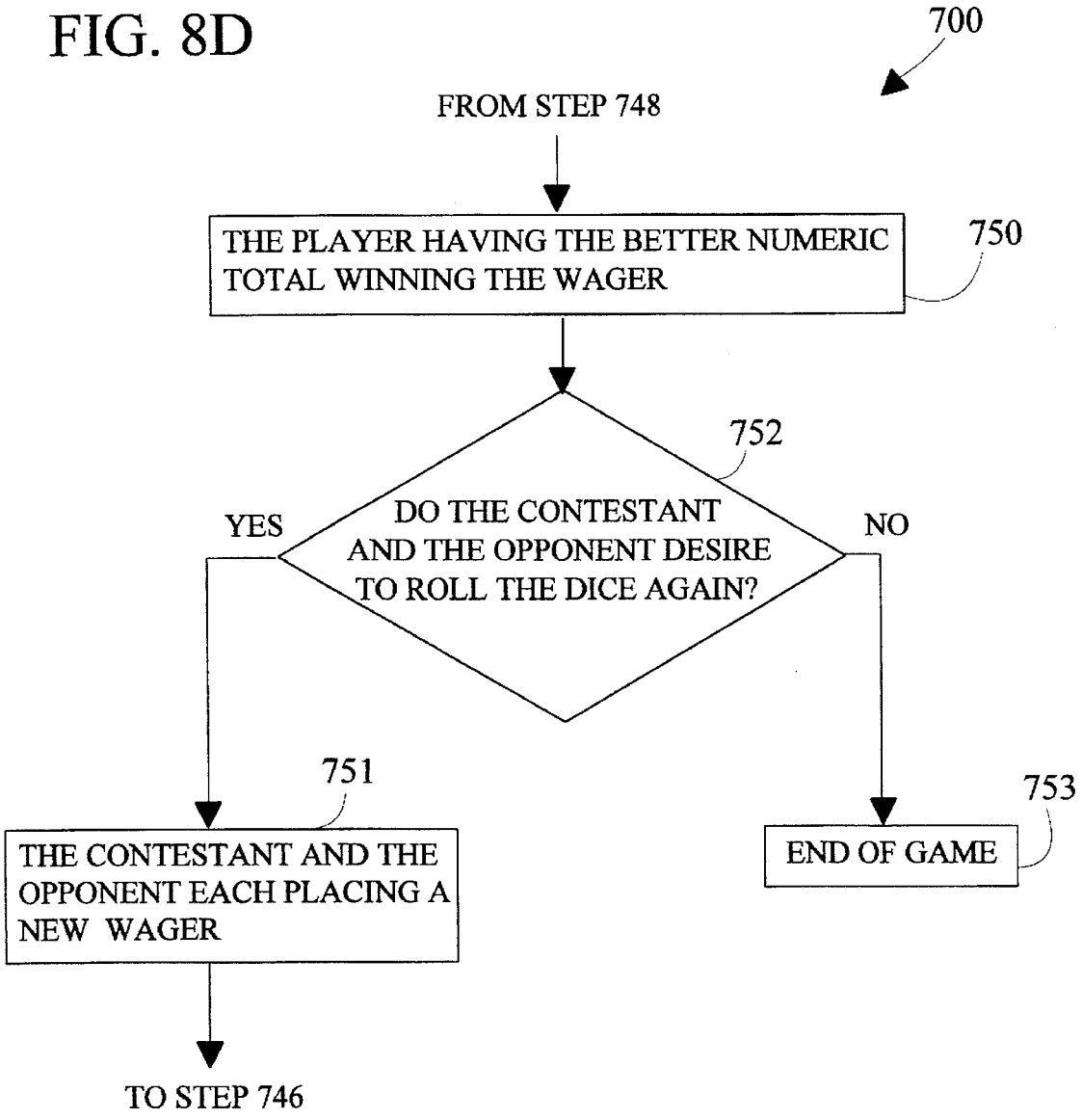

FIG. 7 is an unfolded view of a seventh set of intransitive dice in accordance with the present invention, generally designated as 610. The set is comprised of first die 612, second die 618, third die 624, fourth die 630, fifth die 634, and sixth die 638. Dice 612, 618, and 624 are of a first size, and dice 630, 634, and 638 are of a second size. The die colors and indicia colors are the same as those shown in FIG. 1 and described in the specification for first set of intransitive dice 10. The indicia disposed on the six sides of first die 612 represent the numbers 1, 1, 4, 7, 7, 7. The indicia disposed on the six sides of second die 618 represent the numbers 3, 3, 3, 6, 6, 6. The indicia disposed on the six side of third die 624 represent the numbers 2, 2, 2, 5, 8, 8. The indicia disposed on the six sides of fourth die 630 represent the numbers 1, 1, 4, 7, 7, 7. The indicia disposed on the six sides of fifth die 634 represent the numbers 3, 3, 3, 6, 6, 6. And, the indicia disposed on six sides of sixth die 638 represent the numbers 2, 2, 2, 5, 8, 8. For all two die contests, seventh set of intransitive dice 610 have a winning ratio of at least 1.13.

In a preferred embodiment, first set of intransitive dice 10 are not required to have different die colors or different indicia colors.

In another preferred embodiment, the three second sized dice are removed from second set of intransitive dice 110, third set of intransitive dice 210, and fifth set of intransitive dice 410, thereby forming three sets of only three dice. The sets have indicia representing the same numbers as do sets 110, 210, and 410, however the dice are not required to have different die colors or different indicia colors.

In order to avoid time-consuming ties when two dice are rolled against another two dice, it is necessary that the different numbers on any die be separated by three or a multiple of three. For example, for second die 18 of FIG. 1 (having two different numbers), it is noted that the three and six are separated by three. Similarly, for first die 12 (having three different numbers), it is noted that the one and the four are separated by three, and the four and seven are separated by three.

FIG. 8 is a flow diagram illustrating a method of playing a wagering game using intransitive dice, generally designated as 700. The wagering game 700 is played by two players defined as a contestant and an opponent. The game begins with start terminator step 722. In step 724 a set of six six-sided intransitive dice (designated A, B, C, A', B', and C') in accordance with claim 4 are provided. In a preferred embodiment the six dice include the dice depicted in FIG. 1. For these six dice, the following intransitive relationships exist:

$$A > B > C > A;$$
$$A' > B' > C' > A';$$
$$A+A' < B+B' < C+C' < A+A';$$
$$A+B' < B+C' < C+A' < A+B'; \text{ and,}$$
$$A'+B < B'+C < C'+A < A'+B.$$

In step 726 the contestant and the opponent each place a wager. The wagers of each player may be the same, or may be different. In step 728 the opponent selects a die having a first distinguishing feature. In step 730 the opponent selects a different die having the first distinguishing feature and provides it to the contestant. For example in FIG. 1, the opponent might select large (first distinguishing feature) die 12 for him/herself and select large die 18 for the contestant In step 732, the contestant now has the option of electing to have the two selected dice rolled. If the contestant so elects, in step 734 the selected dice of both the contestant and the opponent are rolled. It makes no difference who physically rolls the dice, the contestant, the opponent, both players, or another individual(s). In step 736, the numeric value of the contestant's die is compared to the numeric value of the opponents's die. The numeric value is the number appearing on the upward face of the die when the die comes to rest after being rolled. In step 738, the player having the better numeric value wins the wager of the other player. In a preferred embodiment, the better numeric value is defined as the higher numeric value. However, in an alternative embodiment, the better numeric value could be defined as the lower numeric value. In step 740 it is determined if the contestant and opponent desire to roll the dice again. If "yes" in step 740, each player places a new wager in step 739, and steps 734, 736, and 738 are repeated one or more times. If "no" in step 740 play then proceeds to end terminator step 741 and the game is concluded. If desired by the players, a new game may begin at step 722.

In step 732 above, if the opponent has selected dice that will result in the contestant having an advantage in the single die contest, then the contestant would obviously elect to proceed to step 734 and have the dice rolled. This will be the case if the contestant has die A and the opponent die B, or the contestant has die B and the opponent die C, or the contestant has die C and the opponent die A. Otherwise, the contestant will elect to proceed from step 732 to step 742 wherein two additional dice are selected.

In step 742 the opponent selects a die having a second distinguishing feature for him/herself and also selects a different die having the second distinguishing feature and provides it to the contestant. The opponent's selection of second distinguishing feature dice must be such that the opponent's second distinguishing feature die bears the same relationship to the opponents's first distinguishing feature die as the contestant's second distinguishing feature die bears to the contestant's first distinguishing feature die. The same relationship may be either (1) the same die color, or (2) the same indicia color, or (3) neither the same die color nor the same indicia color. For example in a preferred embodiment of FIG. 1, assume the opponent selects large die 12 (green die color) for him/herself and large die 18 (red die color) for the contestant. If the opponent then selects small die 30 (also green) for him/herself, then the opponent must select small die 34 (also red) for the contestant. That is if the opponents selects a second die for him/herself that is the same die color as his/her first die, then the opponent must select a second die for the contestant that matches the contestant's first die color. In an alternative selection of second dice, assume the opponent selects small die 30 (white indicia color) color for the contestant which matches the white indicia color of the contestant's large die, then the opponent must also match the indicia color of his/her large die by selecting small die 38 (red indicia color). As is indicated above, it makes no difference whether the opponent first selects a second die for him/herself or if the opponent first selects a second die for the contestant. In either case the fourth and last die selected must bear the stated same relationship.

In step 746 the selected dice of both the contestant and the opponent are rolled. In step 748 the numeric total of the contestant's two dice are compared with the numeric total of the opponent's two dice. In step 750 the player having the better numeric total wins the wager of the other player.

As for the single die contest, in a preferred embodiment, the better numeric total is defined as the higher numeric total. However, in an alternative embodiment, the better numeric total could be defined as the lower numeric total. In step 752 it is determined if the contestant and opponent desire to roll the dice again. If "yes" in step 752, each player places a new wager in step 751, and steps 746, 748, and 750 are repeated one or more times. If "no" in step 752 play then proceeds to end terminator step 753 and the game is concluded. If desired by the players, a new game may begin at step 722.

It can be shown that by requiring the opponent to select a second size die for the contestant which bears the same relationship to the contestant's first size die as does the opponent's second size die to the opponent's first size die, the contestant will always have the advantage in the two dice contest. For example in FIG. 1, if the opponent selected first die 12 (A), selected second die 18 (B) for the contestant, and selected fourth die 30 (A') for the opponent (same die color as die 12)), then the contestant must get die 34 (B'), (same die color as die 18). Therefore, since $A+A'<B+B'$, the contestant has the advantage when the dice are rolled and the higher numeric total wins. Alternatively, if the opponent selected first die 12 (A), selected second die 18 (B) for the contestant, and selected fifth die 30 (B') for the opponent (neither same die color nor same indicia color as die 12), then the contestant must get die 38 (C'), (neither same die color nor same indicia color as die 18). Therefore, since $A+B'<B+C'$, the contestant again has the advantage when the dice are rolled and the higher numeric total wins. A similar analysis may be performed for every possible combination of contestant and opponent selections, with the contestant always having the advantage.

Wagering game 700 may be played with any set of intransitive dice which exhibit the intransitive relationships disclosed herein and recited in claim 4. The sets of intransitive dice depicted in FIGS. 1 through 7 are particularly useful in that they possess the highest winning ratios.

Figure 9:
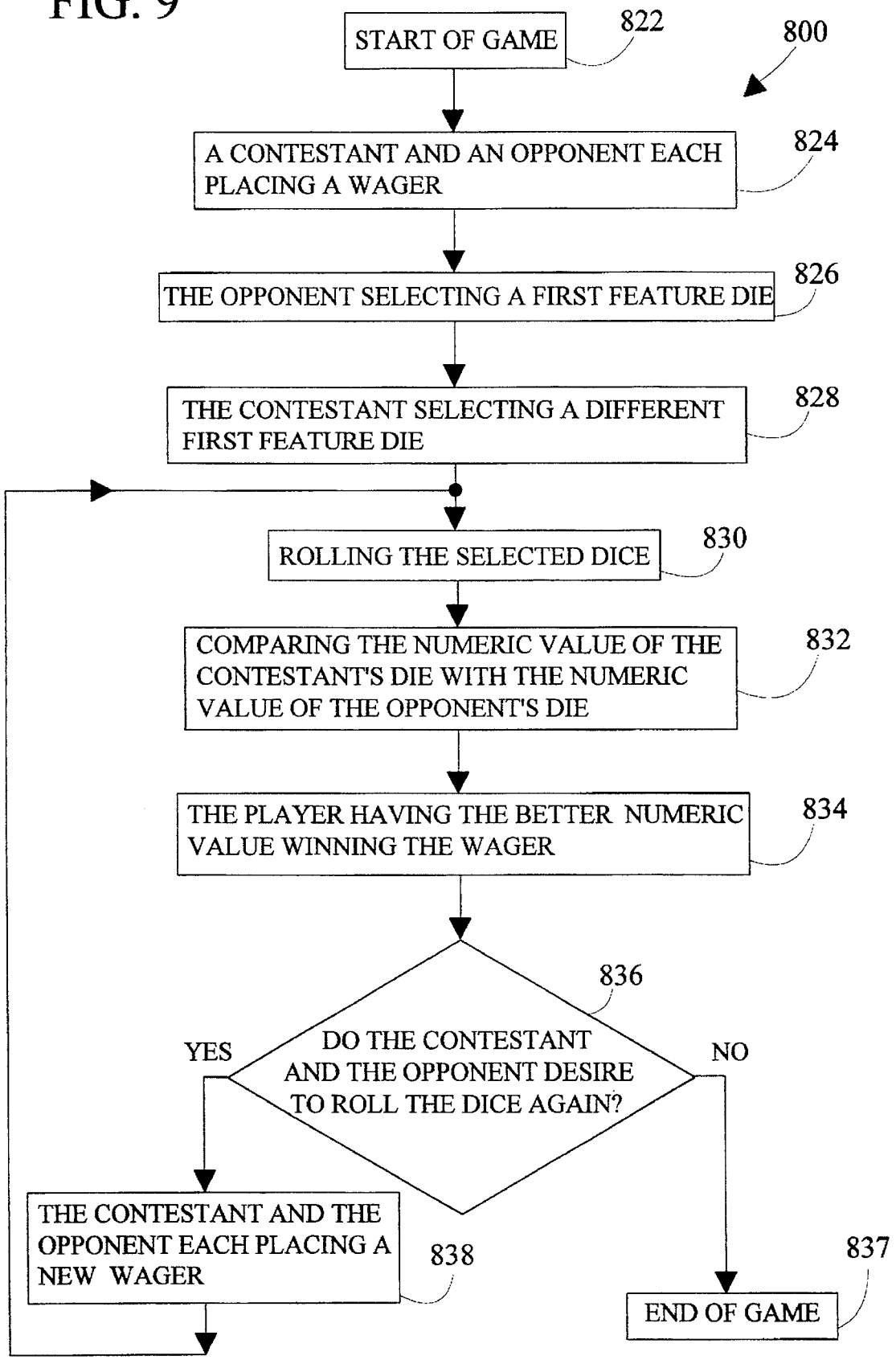

Wagering game 700 may be supplemented by preceding steps of single die contests, of which double die contests are not a part. FIG. 9 is a flow diagram illustrating a method of playing a supplemental single die contest wagering game using intransitive dice, generally designated as 800. In a preferred embodiment of the present invention, wagering game 800 is used as a preceding adjunct to wagering game 700 (however it could also follow wagering game 800). That is, after the opponent is thoroughly convinced that he/she cannot win wagering game 800 by selecting first, he/she will perhaps request that the contestant select the die first. The contestant will then offer wagering game 700 as "a better deal" and way for the opponent to recover his/her loses. Wagering game 800 begins with start terminator step 822. In step 824 the contestant and the opponent each place a wager. The wagers of the contestant and the opponent may or may not be equal. In step 826 the opponent selects a first size die. In step 828 the contestant selects a different first size die. In step 830 the selected dice of both the contestant and the opponent are rolled. In step 832 the numeric value of the contestant's die is compared to the numeric value of the opponent's die. In step 834 the player having the better numeric value wins the wager of the other player. In a preferred embodiment, the better numeric value is defined as the higher numeric value. However, in an alternative embodiment, the better numeric value could be defined as the lower numeric value. In step 836 it is determined if the contestant and opponent desire to roll the dice again. If "yes" in step 836, each player places a new wager in step 838, and steps 830, 832, and 834 are repeated one or more times. If "no" in step 836 play then proceeds to end terminator step 837 and the round of play is concluded. At this point, either another round of wagering game 800 may be played wherein new dice or selected, or play may shift to wagering game 700. As in wagering game 800, the sets of intransitive dice depicted in FIGS. 1 through 7 are particularly useful in that they possess the highest winning ratios.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A plurality of six-sided intransitive dice, comprising:

a first die having a first die color, and having indicia disposed on each of said six sides, said indicia representing numeric values and having a first indicia color different from said first die color;

a second die having a second die color different from said first die color, and having indicia disposed on each of said six sides, said indicia representing numeric values and having second indicia color different from both said second die color and said first indicia color;

a third die having a third die color different from both said first die color and said second die color, and having indicia disposed on each of said six sides, said indicia representing numeric values and having a third indicia color different from said third die color and also different from both said first indicia color and said second indicia color;

said first die, said second die, and said third die each having a first distinguishing feature;

a fourth die having said first die color, and having indicia disposed on each of said six sides, said indicia representing numeric values and having an indicia color the same as either said second indicia color or said third indicia color but different from both said first die color and said first indicia color;

a fifth die having said second die color, and having indicia disposed on each of said six sides, said indicia representing numeric values and having an indicia color the same as either said first indicia color or said third indicia color but different from both said second die color and said second indicia color;

a sixth die having said third die color, and having indicia disposed on each of said six sides, said indicia representing numeric values and having an indicia color the same as either said first indicia color or said second indicia color but different from both said third die color and said third indicia color; and, said fourth die, said fifth die, and said sixth die each having a second distinguishing feature different from said first distinguishing feature.

2. A plurality of six-sided intransitive dice according to claim 1, wherein said first distinguishing feature is a first die size, and wherein said second distinguishing feature is a second die size different from said first die size.

3. A plurality of six-sided intransitive dice according to claim 1, wherein said first die is designated A, said second die is designated B, said third die is designated C, said fourth die is designated A', said fifth die is designated B', and said sixth die is designated C', wherein the following intransitive relationships exist:

$$A > B > C > A;$$
$$A' > B' > C' > A';$$
$$A+A' < B+B' < C+C' < A+A';$$
$$A+B' < B+C' < C+A' < A+B'; \text{ and,}$$
$$A'+B < B'+C < C'+A < A'+B.$$

4. A plurality of six-sided intransitive dice according to claim 3, wherein;

said indicia disposed on said six sides of said first die represent the numbers 1, 1, 4, 4, 4, 7;

said indicia disposed on said six sides of said second die represent the numbers 3, 3, 3, 3, 3, 6;

said indicia disposed on said six side of said third die represent the numbers 2, 2, 2, 5, 5, 5;

said indicia disposed on said six sides of said fourth die represent the numbers 1, 4, 4, 4, 7, 7;

said indicia disposed on said six sides of said fifth die represent the numbers 3, 3, 3, 6, 6, 6; and, said indicia disposed on said six sides of said sixth die represent the numbers 2, 5, 5, 5, 5, 5.

5. A plurality of six-sided intransitive dice according to claim 3, wherein;

said indicia disposed on said six sides of said first die represent the numbers 1, 1, 4, 4, 4, 4;

said indicia disposed on said six sides of said second die represent the numbers 3, 3, 3, 3, 3, 3;

said indicia disposed on said six side of said third die represent the numbers 2, 2, 2, 2, 5, 5;

said indicia disposed on said six sides of said fourth die represent the numbers 1, 1, 4, 4, 4, 4;

said indicia disposed on said six sides of said fifth die represent the numbers 3, 3, 3, 3, 3, 3; and, said indicia disposed on said six sides of said sixth die represent the numbers 2, 2, 2, 2, 5, 5.

6. A plurality of six-sided intransitive dice according to claim 3, wherein;

said indicia disposed on said six sides of said first die represent the numbers 1, 1, 13, 13, 14, 14;

said indicia disposed on said six sides of said second die represent the numbers 8, 8, 9, 9, 10, 10;

said indicia disposed on said six side of said third die represent the numbers 4, 4, 5, 5, 17, 17;

said indicia disposed on said six sides of said fourth die represent the numbers 1, 1, 13, 13, 14, 14;

said indicia disposed on said six sides of said fifth die represent the numbers 8, 8, 9, 9, 10, 10; and, said indicia disposed on said six sides of said sixth die represent the numbers 4, 4, 5, 5, 17, 17.

7. A plurality of six-sided intransitive dice according to claim 3, wherein;

said indicia disposed on said six sides of said first die represent the numbers 1, 1, 4, 4, 4, 7;

said indicia disposed on said six sides of said second die represent the numbers 3, 3, 3, 3, 3, 6;

said indicia disposed on said six side of said third die represent the numbers 2, 2, 2, 5, 5, 5;

said indicia disposed on said six sides of said fourth die represent the numbers 1, 1, 4, 4, 4, 7;

said indicia disposed on said six sides of said fifth die represent the numbers 3, 3, 3, 3, 3, 6; and, said indicia disposed on said six sides of said sixth die represent the numbers 2, 2, 2, 5, 5, 5.

8. A plurality of six-sided intransitive dice according to claim 3, wherein;

said indicia disposed on said six sides of said first die represent the numbers 1, 4, 4, 7, 7, 7;

said indicia disposed on said six sides of said second die represent the numbers 3, 3, 3, 6, 6, 9;

said indicia disposed on said six side of said third die represent the numbers 2, 2, 2, 8, 8, 8;

said indicia disposed on said six sides of said fourth die represent the numbers 1, 4, 4, 7, 7, 7;

said indicia disposed on said six sides of said fifth die represent the numbers 3, 3, 3, 6, 6, 9; and, said indicia disposed on said six sides of said sixth die represent the numbers 2, 2, 2, 8, 8, 8.

9. A plurality of six-sided intransitive dice according to claim 3, wherein;

said indicia disposed on said six sides of said first die represent the numbers 1, 4, 4, 4, 7, 7;

said indicia disposed on said six sides of said second die represent the numbers 3, 3, 3, 6, 6, 6;

said indicia disposed on said six side of said third die represent the numbers 2, 5, 5, 5, 5, 5;

said indicia disposed on said six sides of said fourth die represent the numbers 1, 4, 4, 4, 7, 7;

said indicia disposed on said six sides of said fifth die represent the numbers 3, 3, 3, 6, 6, 6; and, said indicia disposed on said six sides of said sixth die represent the numbers 2, 5, 5, 5, 5, 5.

10. A plurality of six-sided intransitive dice according to claim 3, wherein;

said indicia disposed on said six sides of said first die represent the numbers 1, 1, 4, 7, 7, 7;

said indicia disposed on said six sides of said second die represent the numbers 3, 3, 3, 6, 6, 6;

said indicia disposed on said six side of said third die represent the numbers 2, 2, 2, 5, 8, 8;

said indicia disposed on said six sides of said fourth die represent the numbers 1, 1, 4, 7, 7, 7;

said indicia disposed on said six sides of said fifth die represent the numbers 3, 3, 3, 6, 6, 6; and, said indicia disposed on said six sides of said sixth die represent the numbers 2, 2, 2, 5, 8, 8.

11. A plurality of six-sided intransitive dice according to claim 3, wherein said numeric values disposed on each said die comprise two different numbers which are separated by three or a multiple of three.

12. A plurality of six-sided intransitive dice according to claim 11, further including a third different number disposed on each said die which is separated from each of said two numbers by three or a multiple of three.

13. A plurality of six-sided intransitive dice according to claim 12, further including a fourth different number disposed on each said die which is separated from each of said three numbers by three or a multiple of three.

14. A plurality of six-sided intransitive dice according to claim 1, further including:

said indicia disposed on said six sides of said first representing the numbers 1, 1, 4, 4, 4, 7;

said indicia disposed on said six sides of said second die representing the numbers 3, 3, 3, 3, 3, 6;

said indicia disposed on said six sides of said third die representing the numbers 2, 2, 2, 5, 5, 5;

said indicia disposed on said six sides of said fourth die representing the numbers 1, 4, 4, 4, 7, 7:

said indicia disposed on said six sides of said fifth die representing the numbers 3, 3, 3, 6, 6, 6; and, said indicia disposed on said six sides of said sixth die representing the numbers 2, 5, 5, 5, 5, 5.

15. A plurality of six-sided intransitive dice according to claim 1, further including:

said indicia disposed on said six sides of said first die representing the numbers 1, 1, 4, 4, 4, 4;

said indicia disposed on said six sides of said second die representing the numbers 3, 3, 3, 3, 3, 3; and, said indicia disposed on said six side of said third die representing the numbers 2, 2, 2, 2, 5, 5.

16. A plurality of six-sided intransitive dice according to claim 2, further including:

said indicia disposed on said six sides of said first die representing the numbers 1, 1, 13, 13, 14, 14;

said indicia disposed on said six sides of said second die representing the numbers 8, 8, 9, 9, 10, 10; and, said indicia disposed on said six side of said third die representing the numbers 4, 4, 5, 5, 17, 17.

17. A plurality of six-sided intransitive dice according to claim 1, further including:

said indicia disposed on said six sides of said first die representing the numbers 1, 4, 4, 7, 7, 7;

said indicia disposed on said six sides of said second die representing the numbers 3, 3, 3, 6, 6, 9; and, said indicia disposed on said six side of said third die representing the numbers 2, 2, 2, 8, 8, 8.

18. A method for two players, including a contestant and an opponent, to play a wagering game comprising the steps of:

a) providing a plurality of six-sided intransitive dice, comprising:

a first die having a first die color, and having indicia disposed on each of said six sides, said indicia representing numeric values and having a first indicia color different from said first die color;

a second die having a second die color different from said first die color, and having indicia disposed on each of said six sides, said indicia representing numeric values and having a second indicia color different from both said second die color and said first indicia color;

a third die having a third die color different from both said first die color and said second die color, and having indicia disposed on each of said six sides, said indicia representing numeric values and having a third indicia color different from said third die color and also different from both said first indicia color and said second indicia color;

said first die, said second die, and said third die each having a first distinguishing feature;

a fourth die having said first die color, and having indicia disposed on each of said six sides, said indicia representing numeric values and having an indicia color the same as either said second indicia color or said third indicia color but different from both said first die color and said first indicia color;

a fifth die having said second die color, and having indicia disposed on each of said six sides, said indicia representing numeric values and having an indicia color the same as either said first indicia color or said third indicia color but different from both said second die color and said second indicia color; and, a sixth die having said third die color, and having indicia disposed on each of said six sides, said indicia representing numeric values and having an indicia color the same as either said first indicia color or said second indicia color but different from both said third die color and said third indicia color; and, said fourth die, said fifth die, and said sixth die each having a second distinguishing feature different from said first distinguishing feature;

wherein said first die is designated A, said second die is designated B, said third die is designated C, said fourth die is designated A', said fifth die is designated B', and said sixth die is designated C', wherein the following intransitive relationships exist:

$$A > B > C > A;$$
$$A' > B' > C' > A';$$
$$A+A' < B+B' < C+C' < A+A';$$
$$A+B' < B+C' < C+A' < A+B'; \text{ and,}$$
$$A'+B < B'+C < C'+A < A'+B.$$

b) the contestant and the opponent each placing a wager;

c) the opponent selecting a die having said first distinguishing feature;

d) the opponent selecting a different die having said first distinguishing feature and providing it to the contestant;

e) at the contestant's option, the contestant electing to have said selected dice rolled, else proceeding to step i) below;

f) rolling said selected dice of both the contestant and the opponent;

g) comparing the numeric value of the contestant's die with the numeric value of the opponent's die;

h) the player having the better numeric value winning said wager of the other player, said better numeric value being one of the higher numeric value or the lower numeric value, the contestant and the opponent electing to place a new wager and proceeding to step f) above, else proceeding to step n) below;

i) the opponent selecting a die having said second distinguishing feature for him/herself and also selecting a different die having said second distinguishing feature and providing it to the contestant, such that the opponent's said second distinguishing feature die bears the same relationship to the opponent's said first distinguishing feature die as the contestant's said second distinguishing feature die bears to the contestant's said first distinguishing feature die;

j) said same relationship selected from the group consisting of (1) the same die color, (2) the same indicia color, and (3) neither the same die color nor the same indicia color;

k) rolling said selected dice of both the contestant and the opponent;

l) comparing the numeric total of the contestant's dice with the numeric total of the opponent's dice;

m) the player having the better numeric total winning said wager of the other player, said better numeric total being one of the higher numeric total or the lower numeric total, the contestant and the opponent electing to place a new wager and proceeding to step k) above, else proceeding to step n) below; and, n) ending said wagering game.

19. The method according to claim 18, additionally comprising the below-cited supplemental steps, said supplemental steps performed after step (a) of claim 18 and before step (b) of claim 18:

a) the contestant and the opponent each placing a wager;

b) the opponent selecting a die having said first distinguishing feature;

c) the contestant selecting a different die having said first distinguishing feature;

d) rolling said selected dice of both the contestant and the opponent;

e) comparing the numeric value of the contestant's die with the numeric value of the opponent's die;

f) the player having the better numeric value winning said wager of the other player, said better numeric value being one of the higher numeric value or the lower numeric value, the contestant and the opponent electing to place a new wager and proceeding to step d) above, else proceeding to step g) below; and, g) ending said wagering game or proceeding to step b of claim 18.

20. The method according to claim 18, wherein said plurality of six-sided intransitive dice further includes:

said indicia disposed on said six sides of said first die representing the numbers 1, 1, 4, 4, 4, 7;

said indicia disposed on said six sides of said second die representing the numbers 3, 3, 3, 3, 3, 6;

said indicia disposed on said six side of said third die representing the numbers 2, 2, 2, 5, 5, 5;

said indicia disposed on said six sides of said fourth die representing the numbers 1, 4, 4, 4, 7, 7;

said indicia disposed on said six sides of said fifth die representing the numbers 3, 3, 3, 6, 6, 6; and, said indicia disposed on said six sides of said sixth die representing the numbers 2, 5, 5, 5, 5, 5.

21. The method according to claim 18, wherein said plurality of six-sided intransitive dice further includes:

said indicia disposed on said six sides of said first die representing the numbers 1, 1, 4, 4, 4, 4;

said indicia disposed on said six sides of said second die representing the numbers 3, 3, 3, 3, 3, 3;

said indicia disposed on said six side of said third die representing the numbers 2, 2, 2, 2, 5, 5;

said indicia disposed on said six sides of said fourth die representing the numbers 1, 1, 4, 4, 4, 4;

said indicia disposed on said six sides of said fifth die representing the numbers 3, 3, 3, 3, 3, 3; and, said indicia disposed on said six sides of said sixth die representing the numbers 2, 2, 2, 2, 5, 5.

22. The method according to claim 18, wherein said plurality of six-sided intransitive dice further includes:

said indicia disposed on said six sides of said first die representing the numbers 1, 1, 13, 13, 14, 14;

said indicia disposed on said six sides of said second die representing the numbers 8, 8, 9, 9, 10, 10;

said indicia disposed on said six side of said third die representing the numbers 4, 4, 5, 5, 17, 17;

said indicia disposed on said six sides of said fourth die representing the numbers 1, 1, 13, 13, 14, 14;

said indicia disposed on said six sides of said fifth die representing the numbers 8, 8, 9, 9, 10, 10; and, said indicia disposed on said six sides of said sixth die representing the numbers 4, 4, 5, 5, 17, 17.

23. The method according to claim 18, wherein said plurality of six-sided intransitive dice further includes:

said indicia disposed on said six sides of said first die representing the numbers 1, 1, 4, 4, 4, 7;

said indicia disposed on said six sides of said second die representing the numbers 3, 3, 3, 3, 3, 6;

said indicia disposed on said six side of said third die representing the numbers 2, 2, 2, 5, 5, 5;

said indicia disposed on said six sides of said fourth die representing the numbers 1, 1, 4, 4, 4, 7;

said indicia disposed on said six sides of said fifth die representing the numbers 3, 3, 3, 3, 3, 6; and, said indicia disposed on said six sides of said sixth die representing the numbers 2, 2, 2, 5, 5, 5.

24. The method according to claim 18, wherein said plurality of six-sided intransitive dice further includes:

said indicia disposed on said six sides of said first die representing the numbers 1, 4, 4, 7, 7, 7;

said indicia disposed on said six sides of said second die representing the numbers 3, 3, 3, 6, 6, 9;

said indicia disposed on said six side of said third die representing the numbers 2, 2, 2, 8, 8, 8;

said indicia disposed on said six sides of said fourth die representing the numbers 1, 4, 4, 7, 7, 7;

said indicia disposed on said six sides of said fifth die representing the numbers 3, 3, 3, 6, 6, 9; and, said indicia disposed on said six sides of said sixth die representing the numbers 2, 2, 2, 8, 8, 8.

25. The method according to claim 18, wherein said plurality of six-sided intransitive dice further includes:

said indicia disposed on said six sides of said first die representing the numbers 1, 4, 4, 4, 7, 7;

said indicia disposed on said six sides of said second die representing the numbers 3, 3, 3, 6, 6, 6;

said indicia disposed on said six side of said third die representing the numbers 2, 5, 5, 5, 5, 5;

said indicia disposed on said six sides of said fourth die representing the numbers 1, 4, 4, 4, 7, 7;

said indicia disposed on said six sides of said fifth die representing the numbers 3, 3, 3, 6, 6, 6; and, said indicia disposed on said six sides of said sixth die representing the numbers 2, 5, 5, 5, 5, 5.

26. The method according to claim 18, wherein said plurality of six-sided intransitive dice further includes:

said indicia disposed on said six sides of said first die representing the numbers 1, 1, 4, 7, 7, 7;

said indicia disposed on said six sides of said second die representing the numbers 3, 3, 3, 6, 6, 6;

said indicia disposed on said six side of said third die representing the numbers 2, 2, 2, 5, 8, 8;

said indicia disposed on said six sides of said fourth die representing the numbers 1, 1, 4, 7, 7, 7;

said indicia disposed on said six sides of said fifth die representing the numbers 3, 3, 3, 6, 6, 6; and, said indicia disposed on said six sides of said sixth die representing the numbers 2, 2, 2, 5, 8, 8.

* * * * *